US005371522A

United States Patent [19]

Miyawaki et al.

[11] Patent Number: 5,371,522

[45] Date of Patent: Dec. 6, 1994

[54] APPARATUS FOR ERASING AND RECORDING DATA IN A THERMOSENSITIVE RECORDING MEDIUM

[75] Inventors: Katsuaki Miyawaki; Yusuke Takeda; Toshio Kawakubo; Makoto Obu, all of Yokohama; Yoshihiko Hotta; Fumihito Masubuchi, both of Mishima, all of Japan

[73] Assignee: Ricoh Company, Ltd., Tokyo, Japan

[21] Appl. No.: 32,327

[22] Filed: Mar. 17, 1993

[30] Foreign Application Priority Data

Mar. 18, 1992 [JP] Japan ..... 4-061881
Mar. 18, 1992 [JP] Japan ..... 4-062496
Sep. 17, 1992 [JP] Japan ..... 4-248228

[51] Int. Cl.[5] ..... B41M 5/28; B41J 2/32

[52] U.S. Cl. ..... 346/76 PH; 346/76 R; 346/76 L; 346/108; 346/135.1

[58] Field of Search ..... 346/76 R, 76 PH, 76 L, 346/108, 135.1, 1.1; 359/36, 43, 44, 45

[56] References Cited

U.S. PATENT DOCUMENTS 4,734,359 3/1988 Oguchi et al. ..... 430/945
5,157,011 10/1992 Okabe et al. ..... 503/201

*Primary Examiner*—Benjamin R. Fuller
*Assistant Examiner*—Huan Tran
*Attorney, Agent, or Firm*—Oblon, Spivak, McClelland, Maier & Neustadt

[57] ABSTRACT

An apparatus for recording data in a thermosensitive recording medium at a first temperature after erasing data written in the medium at a second temperature. The apparatus desirably erases data stored in a recording medium with no regard to the time elapsed after writing, condition of storage, writing conditions, the number of repetitive writing and erasing operations, etc.

15 Claims, 9 Drawing Sheets

APPARATUS FOR ERASING AND RECORDING DATA IN A THERMOSENSITIVE RECORDING MEDIUM

BACKGROUND OF THE INVENTION

The present invention relates to an apparatus for recording data in a thermosensitive recording medium and, more particularly, to a recording apparatus for writing data in a thermosensitive recording medium at a first temperature after erasing data written in the medium at a second temperature.

It has been customary with a recording apparatus of the type described to erase data recorded in a thermosensitive recording medium by applying a fixed voltage to a thermal head, or erasing member, with no regard to, for example, the time elapsed after the writing of the data. Specifically, the heat to be generated by the erasing member is not changed in matching relation to the conditions of the medium. Generally the erasure characteristic of such a medium changes with the time elapsed after the writing of data, the storage condition, number of times of repetitive writing and erasing operations, etc. Therefore, if the erasure is effected at the same temperature at all times, it is likely that the data written in the medium is difficult to erase or cannot be fully erased.

SUMMARY OF THE INVENTION

It is, therefore, an object of the present invention to provide an apparatus capable of erasing data written in a thermal recording medium with no regard to the time elapsed after the writing of the data, the storage condition, the number of times of repetitive writing and erasing operations, etc.

In accordance with the present invention, an apparatus for recording data in a thermosensitive recording medium comprises a writing member capable of repetitively writing data in the recording medium at a first temperature, an erasing member capable of repetitively erasing data written in the recording medium at a second temperature and located upstream of the writing member in an intended direction of transport of the recording medium for a writing operation, and control means for controlling heat to be generating by the erasing member.

Also, in accordannce with the present invention, an apparatus for recording data in a thermosensitive recording medium comprises a writing member capable of repetitively writing data in the recording medium at a first temperature, an erasing member capable of repetitively erasing data written in the recording medium at a second temperature, an elapsed time determining device located upstream of the erasing member with respect to an intended direction of transport of the recording medium for a writing operation for determining a period of time elapsed after the previous writing of data in the recording medium, and a controller for controlling heat to be generated by the erasing member in response to an output of the elapsed time determining device.

Further, in accordance with the present invention, an apparatus for recording data in a thermosensitive recording medium comprises a writing member capable of repetitively writing data in the recording medium at a first temperature, an erasing member capable of repetitively erasing data written in the recording medium at a second temperature and located upstream of the writing member in an intended direction of transport of the recording medium for a writing operation, and a controller for controlling a heating temperature of the erasing member such that the heating temperature is higher than a temperature necessary for data just written in the recording medium to be immediately erased.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
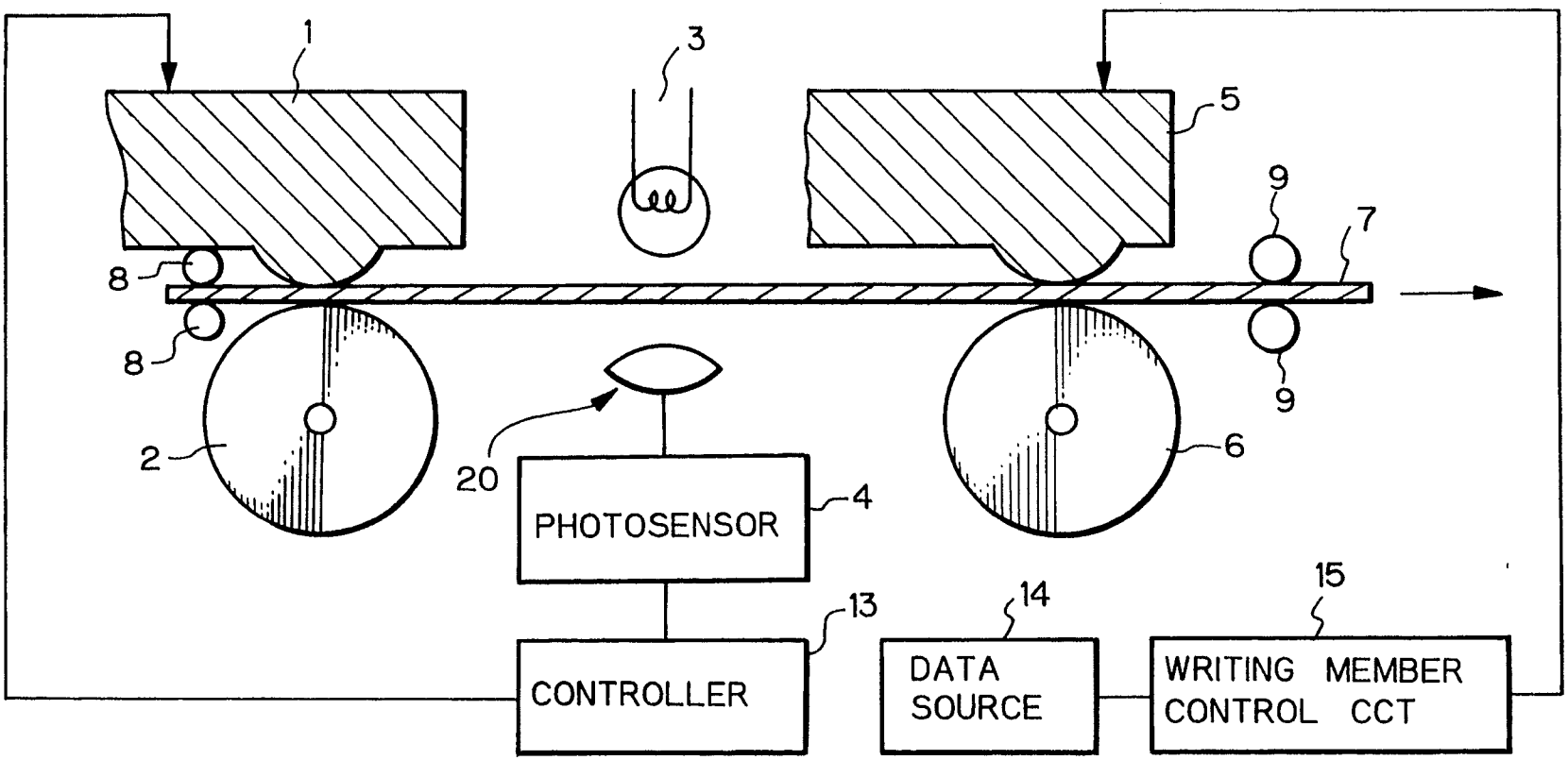
FIG. 1 is a vertical section showing a first embodiment of the recording apparatus in accordance with the present invention.

Preferred embodiments of the thermal recording apparatus in accordance with the present invention will be described with reference to FIGS. 1–8. Since many parts and elements included in the embodiments are identical, they will be commonly designated by the reference numerals used in the first embodiment, and a redundant description will not be made to avoid redundancy. Let the following description concentrate on a thermosensitive recording medium 7 of the kind which allows data to be repetitively written therein (clouding or coloring) at a first temperature and allows it to be repetitively erased (making transparent or erasing color) at a second temperature higher than the first temperature.

Referring to FIG. 1, a first embodiment of the present invention includes an erasing member 1 and a writing member 5 which are implemented as thermal heads. The erasing member 1 is located upstream of the writing member 5 with respect to an intended direction of transport of the recording medium 7 for a writing operation. A first and a second platen roller 2 and 6 are made of an elastic material and are located to face the easing member 1 and the writing member 5, respectively. A density sensing device 20 is located between the members 1 and 5 for sensing the density of the medium 7. The device 20 is made up of a light source 3 for illuminating the medium 7, and a light-sensitive member, or photosensor as referred to hereinafter, 4 facing the light source 3 with the intermediary of the medium 7. Light issued from the light source 3 and transmitted through the medium 7 is incident on the photosensor 4. The resulting output of the photosensor 4 is applied to a controller 13. The controller 13 controls the heat to be generated by the erasing member 1 and the reversible rotation of a first and a second transport roller pair 8 and 9 according to a predetermined program. A data source or data circuit 14 delivers a data signal to be written to a writing member control circuit 15. In response, this control circuit 15 causes the writing member 5 to perform a corresponding writing operation.

While the erasing member 1 and writing member 5 are each implemented as an independent thermal head, they may, of course, be constructed into a single erase/-write thermal head. The photosensor 4 may be of a reflection type and may be located at the same side as the light source 3 with respect to the medium 7, if desired. Then, a reflector will be attached to the surface of the medium 7 opposite to the surface facing the light source 3. Alternatively, a reflecting material may be applied to the medium 7.

Figure 2:
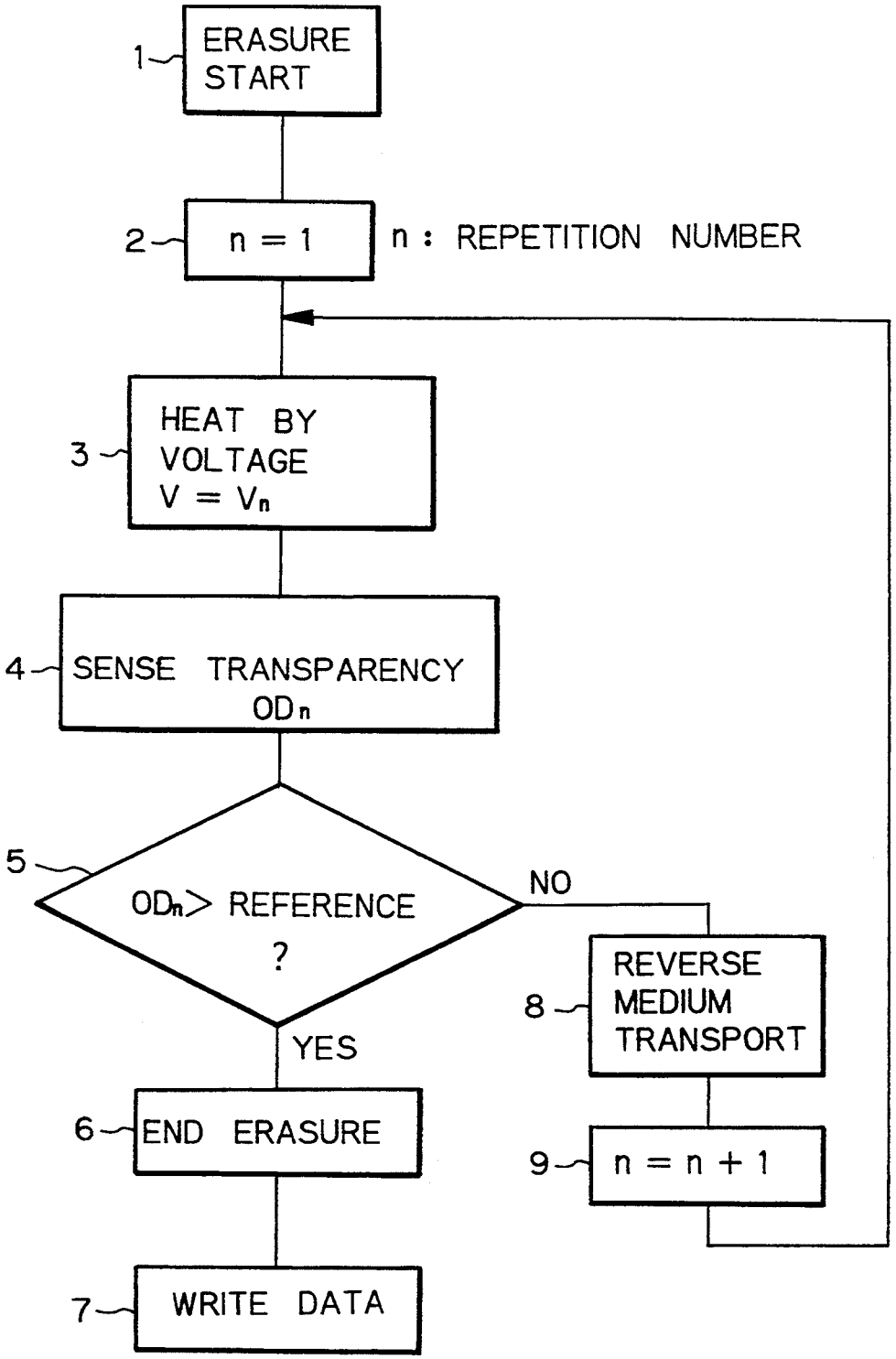
FIG. 2 is a flowchart demonstrating a specific operation of the embodiment.

FIG. 2 shows a specific control procedure to be executed by the controller 13. As shown, to erase data written in the medium 7 (step 1), a voltage $V=V_1$ is applied to the erasing member 1 (step 3). At this instant, the medium 7 is transported from the left to the right as viewed in FIG. 1 while the light source 3 and photosensor 4 senses the degree of transparency of the medium 7 (step 4). The controller 13 determines whether or not the transparency sensed by the photosensor 4 is higher than a predetermined or reference transparency (step 5). If the answer of the step 5 is no, meaning that the transparency is insufficient, the controller 13 reverses the transport rollers 8 and 9 (steps 8 and 9) to return the medium 7 to the original position, i.e., the position before the start of erasure. Then, the controller 13 applies a voltage $V_2$ higher than the voltage $V_1$ applied for the first erasure to the erasing member 1. This is repeated until the actual transparency of the medium 7 exceeds the reference transparency. When the actual transparency exceeds the reference transparency, the controller 13 determines that the erasure has been completed (step 6) and moves the medium 7 to the right as viewed in FIG. 1. Then, the writing member 5 writes desired data in the medium 7 (step 7).

Figure 3:
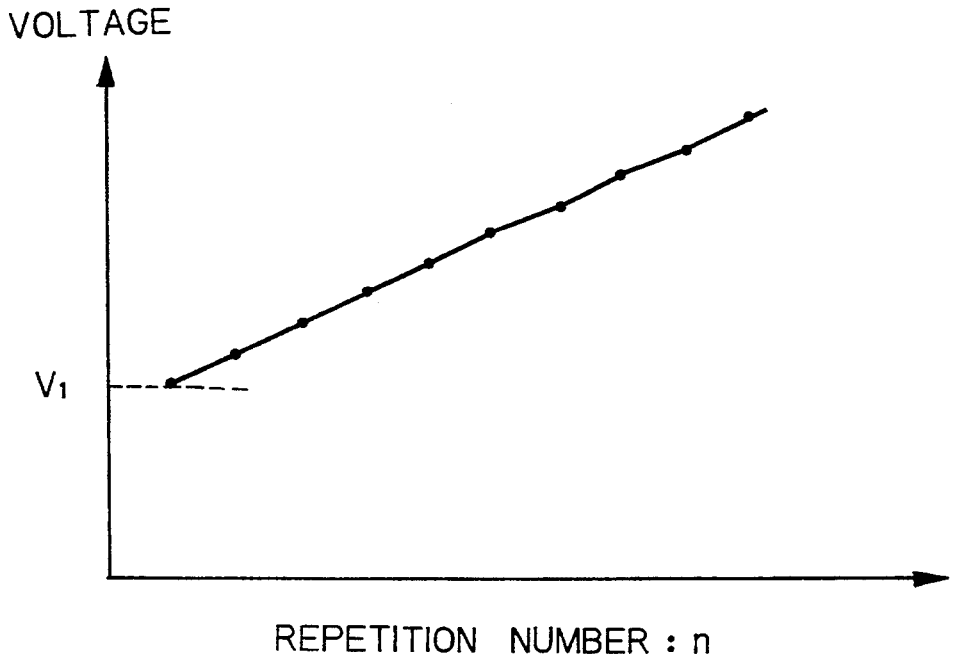
FIG. 3 is a graph showing a relation between the number of times that erasure is performed and the voltage applied to an erasing member particular to the embodiment.
Figure 4:
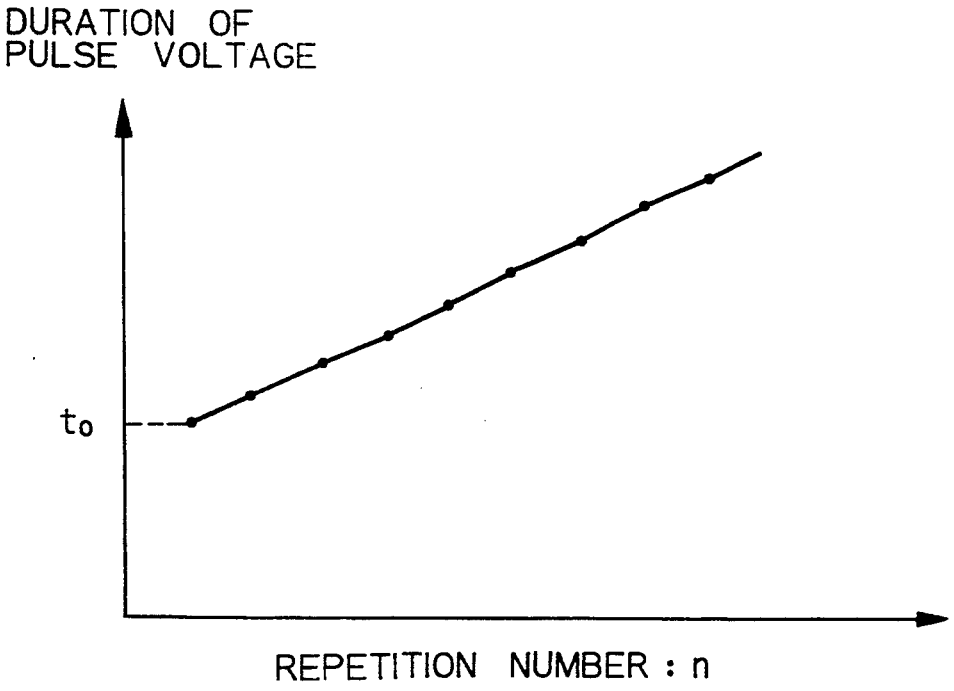
FIG. 4 is a graph showing a relation between the number of times that erasure is repeated and a pulse voltage applied to the erasing member also particular to the embodiment.

As shown in FIG. 3, in the illustrative embodiment, the controller 13 changes the voltage to the erasing member 1 every time it causes the erasing member 1 to repeat the above-stated erasing operation. Although the voltage to the erasing member 1 is shown in FIG. 3 as sequentially increasing with the number of times n that the erasing operation is repeated, the former may be sequentially reduced with the latter. Further, as shown in FIG. 4, the period of time during which the voltage is applied to the erasing member 1 may be changed in place of the voltage itself with the repetition number n. The period of time shown in FIG. 4 is also only illustrative and may be sequentially reduced with the repetition number n. The method shown in FIG. 3 controls the heat to be generated by the erasing member 1 on the basis of the voltage to the erasing member 1, while the method shown in FIG. 4 controls it on the basis of the duration of the drive of the erasing member 1 while maintaining the voltage constant.

Figure 5:
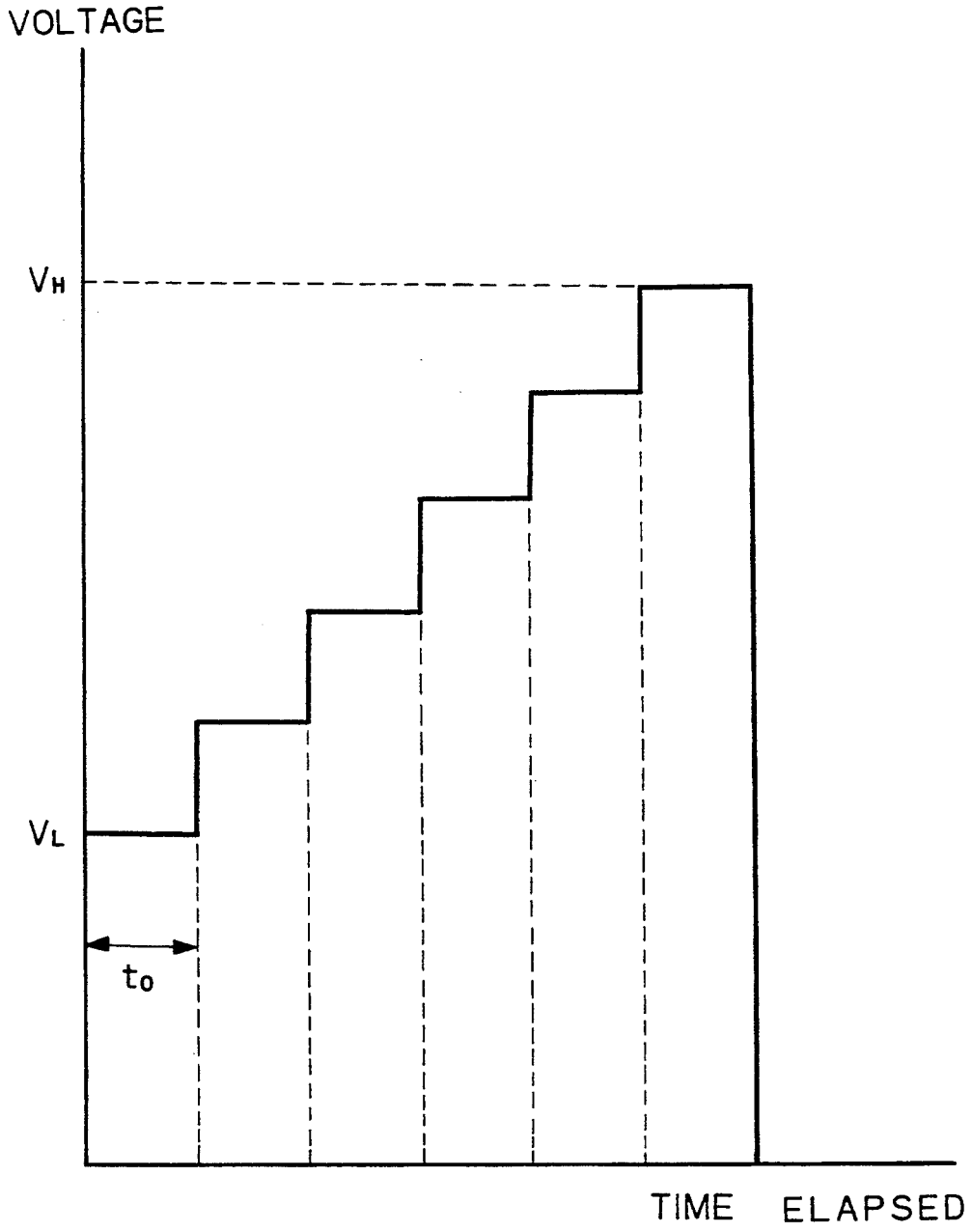
FIG. 5 is a graph showing a relation between the time elapsed after the writing of data in a thermosensitive recording medium and the voltage applied to the erasing member also particular to the embodiment.
Figure 9:
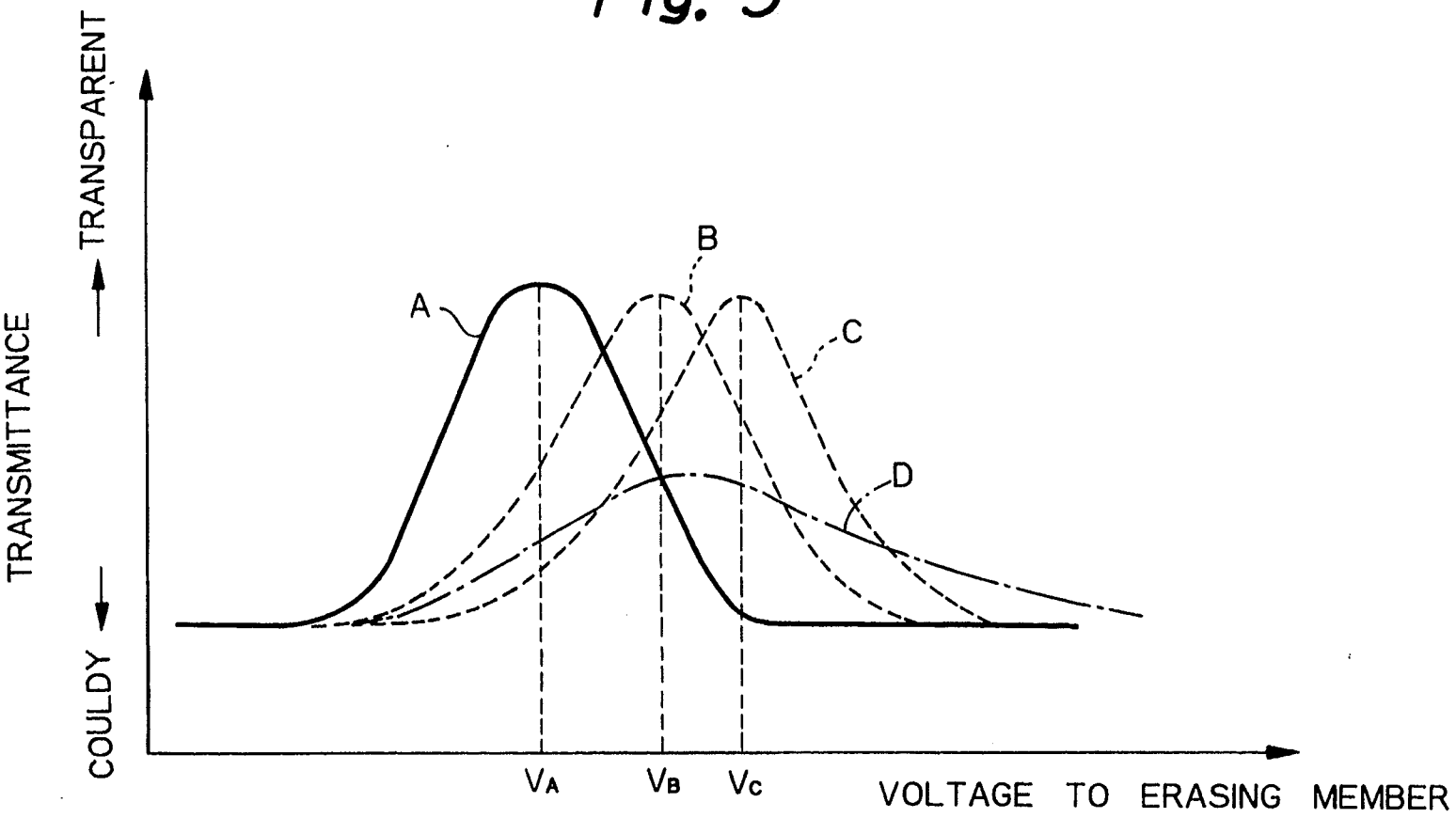
FIG. 9 ,is a graph showing a conventional relation between the voltage applied to an erasing member and the degree of transparency with respect to some different times elapsed after the writing of data.
Figure 10:
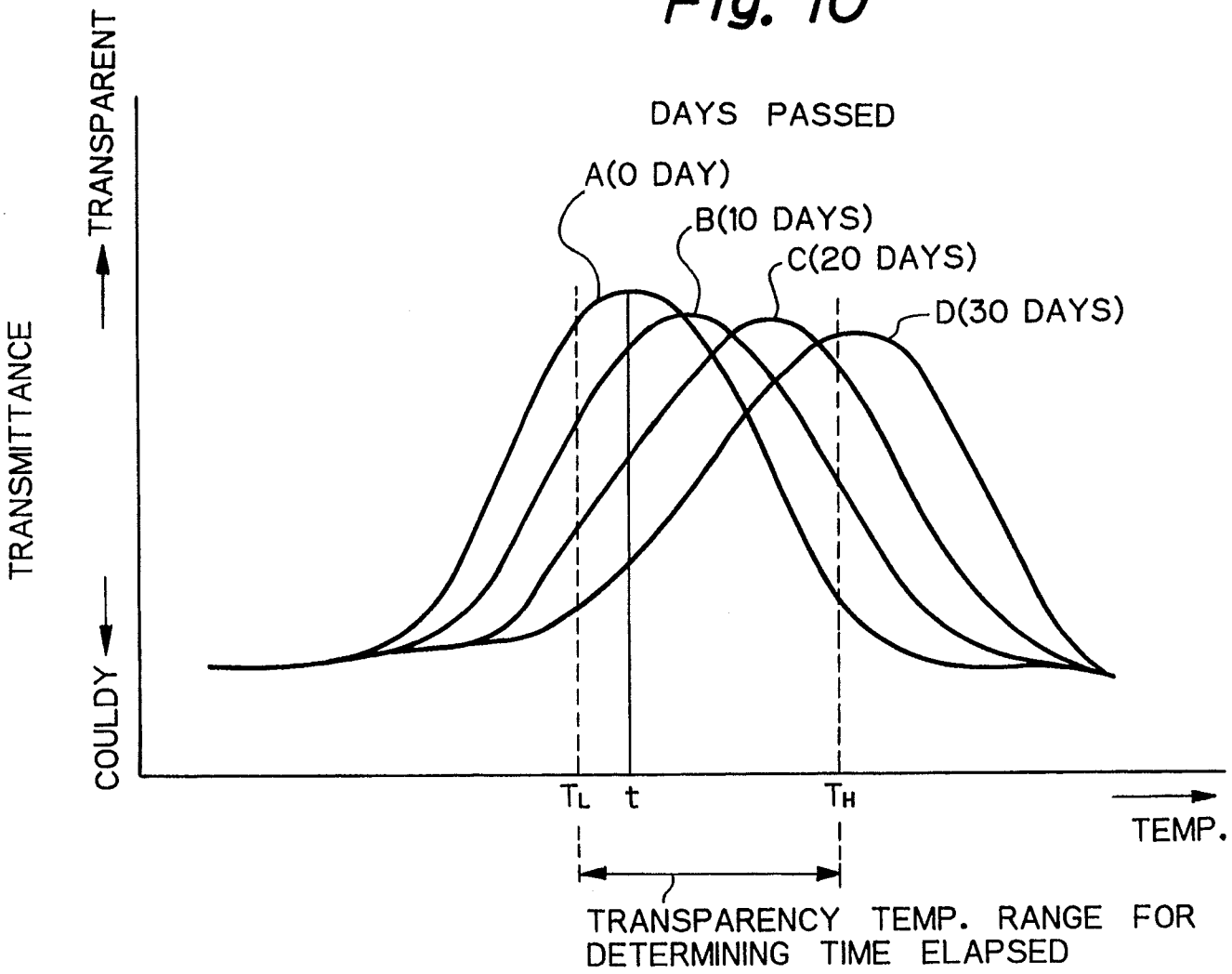
FIG. 10 is a graph showing a conventional relation between the heating temperature and the degree of transparency with respect to some different times elapsed after the writing of data.

FIG. 9 shows a relation heretofore set up between the transparency and the voltage to an erasing member with respect to specific periods of time elapsed after the writing of data in a photosensitive recording medium. FIG. 10 shows a relation between the transparency and the heating temperature. In FIG. 9, a curve D indicates that the medium is erased only little by little, resulting in an increase in the required number of repetitive erasures. To eliminate this occurrence, the illustrative embodiment selects a minimum duration of voltage application ($t_0$, FIG. 4) which is 10 milliseconds or above. In the embodiment, assume that condition in which the medium 7 has been stored is known, and that the period of time elapsed after the writing of data is also known or is limited by specifications. Then, as shown in FIG. 5, on the basis of the known data shown in FIGS. 9 and 10, e.g., $V_C$ and $V_A$, voltages $V_L$ and $V_H$ satisfying relations $V_L<V_A$ and $V_H>V_C$, respectively, are selected. The range between the voltages VL and VH is suitably divided and selectively applied to the erasing member 1. This is successful in erasing the medium 7 in all the conditions which satisfy the specifications. It is to be noted that the duration $t_0$ of application of a single voltage is longer than or equal to 10 milliseconds, as mentioned above. With this manner of erasure, it is possible to omit the optical density sensing device 20 of the embodiment and to promote rapid erasure. When the density sensing device 20 is used and if the sensed transparency of the medium 7 is lower than the reference value, a message indicating that the medium 7 is not usable may be displayed on a display, not shown.

Figure 6:
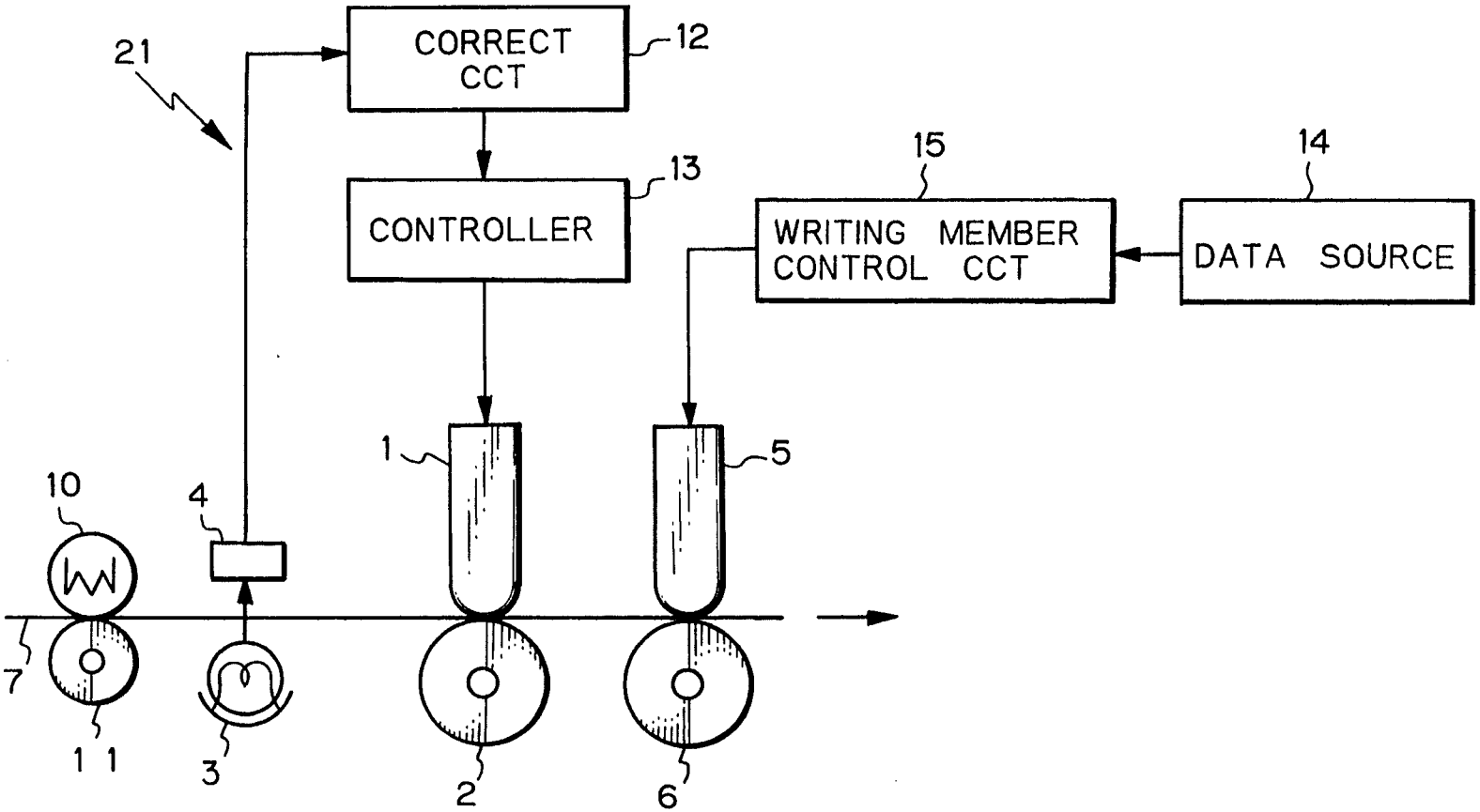
FIGS. 6, 7 and 8 are diagrams each schematically showing an alternative embodiment of the present invention.

Referring to FIG. 6, a second embodiment of the present invention will be described. As shown, a heating member 10 is located upstream of the easing member 1 while a pressure roller 11 is positioned to face the heating member 10 with the intermediary of the recording medium 7. The heating member 10 and the pressure roller 11 are respectively caused to heat and to rotate by respective drive sources, not shown. An elapsed time determining device 21 is interposed between the erasing member 1 and the heating member 10 and is made up of a light source 3, a light-sensitive element or photosensor 4, and a correcting circuit 12. Light issued from the light source 3 and transmitted through the medium 7 is incident on the photosensor 4. The resulting output of the photosensor 4 is applied to the correcting circuit 12 whose output is in turn delivered to the controller 13. In response, the controller 13 controls the erasing member 1 according to a predetermined program.

In operation, as the medium 7 storing data therein is fed to the heating member 10, it is heated by the heating member 10 to have the data erased. At this instant, the degree of erasure depends on the period of time elapsed after the time when the data was written. Specifically, the longer the period of time elapsed after the previous writing, the more the cloudy state of the medium 7 remains. The degree of erasure is determined by the photosensor 4 in terms of the quantity of light transmitted through the medium 7, i.e., the density of the medium 7 is converted to a voltage proportional to the quantity of light incident on the photosensor 4. The correcting circuit 12 stores beforehand data representative of a relation between the heating temperature and the resulting degree of transparency, i.e., data for transforming a given degree of transparency to a corresponding time elapsed. By comparing the output of the photosensor 4 with such data, the correcting circuit 12 determines a period of time elapsed and delivers it to the controller 13. In response, the controller 13 controls the erasing member 1 to erase the data recorded in the medium 7. At this instant, the erasing member 1 is driven in an optimal condition matching the time elapsed by a pulse having a particular duration or by a particular number of pulses. The medium 7 having the data fully erased is fed to the nip portion between the writing member 5 and the platen roller 6 to write new data therein. The temperature of the heating member 10 is selected in the range shown in FIG. 10 (TH-TL) which makes the medium 7 transparent.

Figure 7:
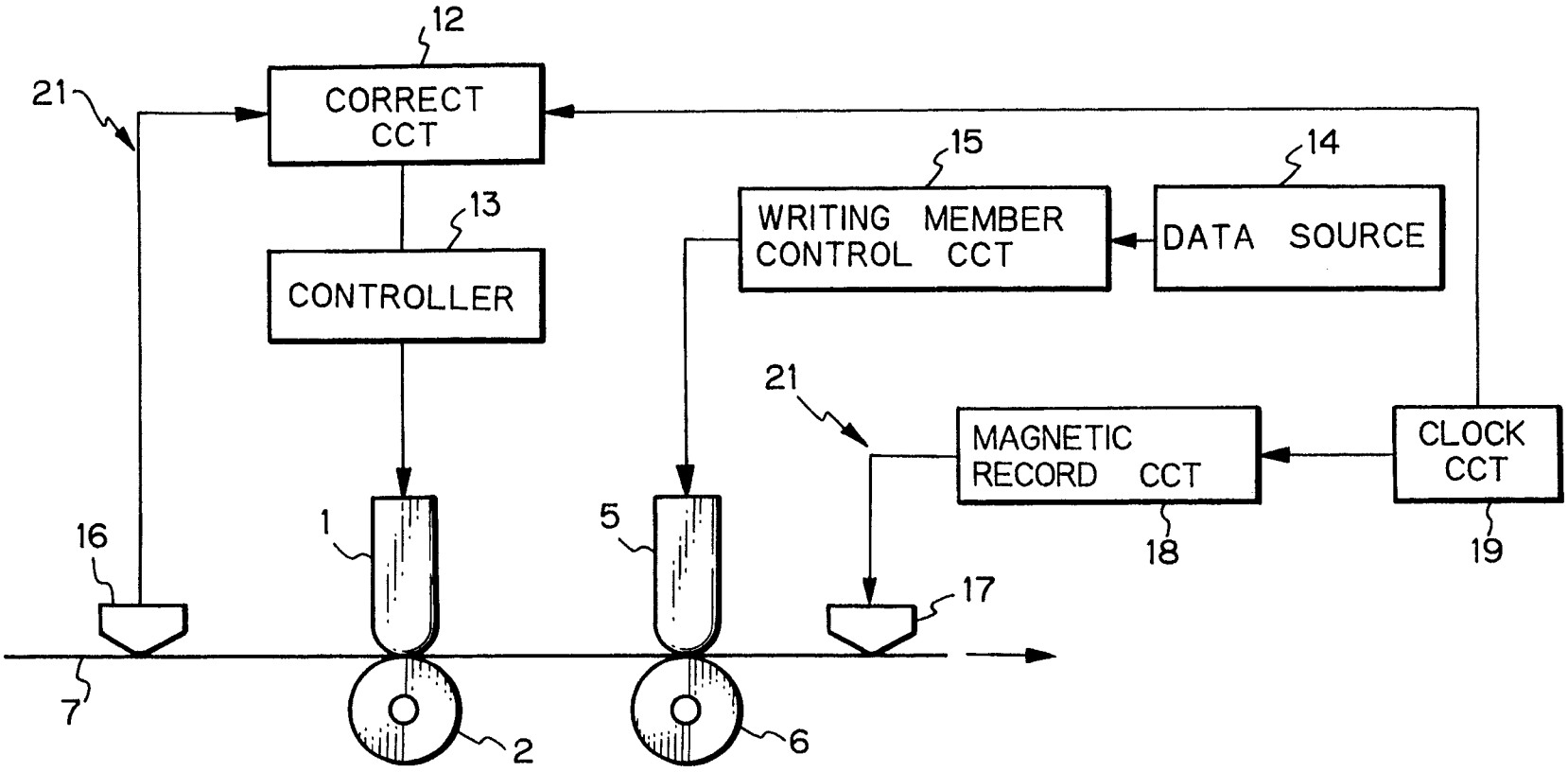

FIG. 7 shows a third embodiment of the present invention including a magnetic reading member 16 and a magnetic recording member 17 constituting the elapsed time determining device 21 in combination. The magnetic reading member 16 and the magnetic recording member 17 are respectively located upstream of the erasing member 1 and downstream of the writing member 5. The correcting circuit 12 is connected to the reading member 16, control circuit 13, and a clock circuit 19. A magnetic recording circuit 18 is connected to the clock circuit 19 and recording member 17. The heating member 10 and pressure roller 11 are omitted in the embodiment. A magnetic recording medium, not shown, is provided in part of the medium 7 to allow the recording member 17 to magnetically record date and time data therein.

In operation, the reading member 16 reads date and time data recorded in the above-mentioned magnetic recording medium last time and feeds it to the correcting circuit 12. The correcting circuit 12 calculates a period of time elapsed on the basis of the data read by the reading member 16 and date and time data from the clock circuit 19. On receiving the output, i.e., the time elapsed from the correcting circuit 12, the controller 13 causes the erasing member 1 to erase the data of the medium 7. Subsequently, the writing member 5 writes data in the medium 7, and then the recording member 17 magnetically records date and time data fed from the clock circuit 19 via the recording circuit 18.

Figure 8:
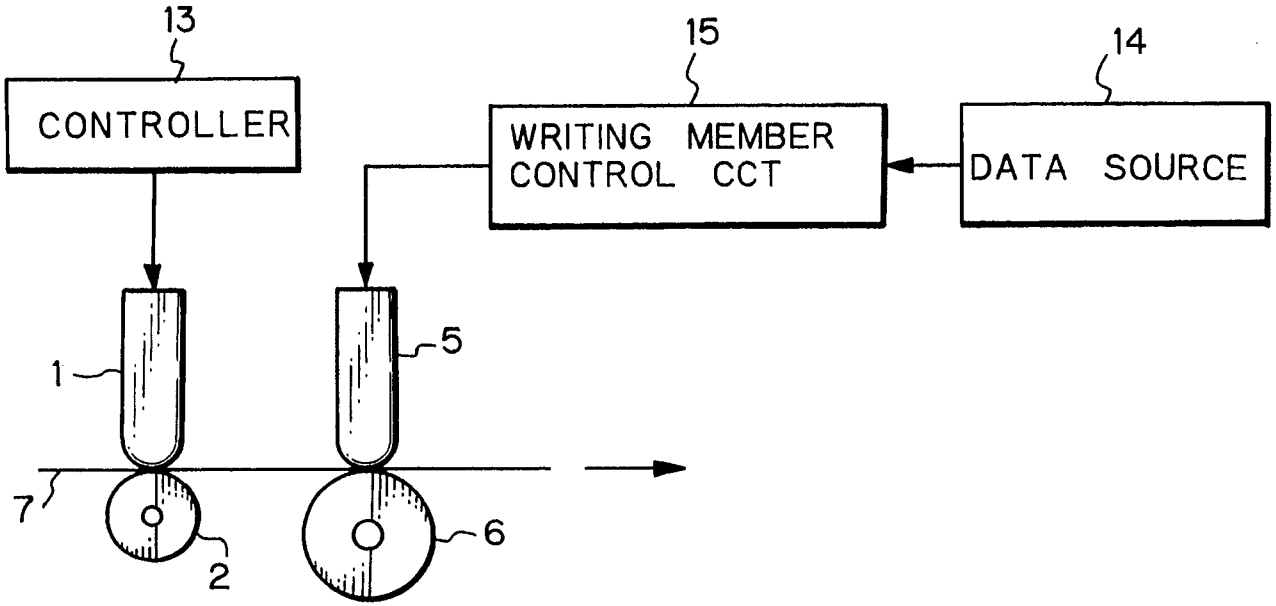

FIG. 8 shows a fourth embodiment of the present invention having the erasing member 1, writing member 5, and controller 13 for controlling the erasing member 1. This embodiment erases data of medium 7 and then writes new data therein without determining the period of time elapsed. Specifically, in this embodiment, the controller 13 controls the heating temperature of the erasing member 1 such that it is higher than the highest temperature which will make the medium 7 transparent when data is written and then immediately erased. Such a heating temperature is higher than a temperature t at which the transparency of a curve A (zero day elapsed), FIG. 10, is highest.

In summary, it will be seen that the present invention provides a recording apparatus which accurately controls the heating of an erasing member with a simple arrangement, and desirably erases data stored in a recording medium with no regard to the time elapsed after writing, condition of storage, writing condition, the number of repetitive writing and erasing operations, etc., thereby allowing image data to be written in the medium with high quality afterwards. Further, the apparatus of the invention fully erases data until the medium achieves a predetermined degree of transparency, and can surely sense the transparency of the medium.

Various modifications will become possible for those skilled in the art after receiving the teachings of the present disclosure without departing from the scope thereof.

What is claimed is:

1. An apparatus for recording data in a thermosensitive recording medium comprising:

a writing member for repetitively writing data in the recording medium at a first temperature;

an erasing member for repetitively erasing data written in the recording medium at a second temperature and located upstream of said writing member in an intended direction of transport of said recording medium for a writing operation; and control means for controlling heat to be generated by erasing member;

density sensing means located in close proximity and downstream to said erasing member for sensing density of data written in said recording medium.

2. An apparatus as claimed in claim 1, wherein said density sensing means comprises a light source for issuing light toward one of opposite surfaces of said recording medium to be transmitted through said recording medium, and a light-sensitive member positioned at the other one of said opposite surfaces of said recording medium for sensing the light transmitted through said recording medium.

3. An apparatus as claimed in claim 1, wherein said density sensing means comprises a light source for issuing light toward one of opposite surfaces of said recording medium, a light-sensitive member for sensing a reflection from said recording medium, and a reflector provided on the other one of said opposite surfaces of said recording medium.

4. An apparatus as claimed in claim 1, wherein said control means controls heat to be generated by said erasing member in response to an output of said density sensing means.

5. An apparatus as claimed in claim 1, wherein said control means causes an erasing operation to be repeated with said recording medium until an output of said density sensing means reaches a predetermined value.

6. An apparatus as claimed in claim 1, wherein the second temperature is higher than the first temperature.

7. An apparatus for recording data in a thermosensitive recording medium, comprising;

a writing member for repetitively writing data in the recording medium at a first temperature;

an erasing member for repetitively erasing data written in the recording medium at a second temperature and located upstream of said writing member in an intended direction of transport of said recording medium for a writing operation; and control means for controlling heat to be generated by erasing member, wherein said control means changes heat to be generated by said erasing member every time an erasing operation is repeated with said recording medium.

8. An apparatus as claimed in claim 7, wherein the second temperature is higher than the first temperature.

9. An apparatus for recording data in a thermosensitive recording medium, comprising:

a writing member for repetitively writing data in the recording medium at a first temperature;

an erasing member for repetitively erasing data written in the recording medium at a second temperature, the erasing member being located upstream of the writing member with respect to an intended direction of transport of the recording medium for a writing operation;

elapsed time determining means located upstream of said erasing member with respect to the intended direction of transport of the recording medium for a writing operation for determining a period of time elapsed after a previous writing of data in said recording medium; and control means for controlling heat to be generated by said erasing member in response to an output of said elapsed time determining means.

10. An apparatus as claimed in claim 9, further comprising a heating member located upstream of the elapsed time determining means for heating the recording medium.

11. An apparatus as claimed in claim 9, wherein said elapsed time determining means comprises erasure condition sensing means for determining an erasure condition of data of the recording medium having been heated by said heating member.

12. An apparatus as claimed in claim 9, wherein said control means controls a heating temperature of said erasing member to a range for erasing data of the recording medium.

13. An apparatus as claimed in claim 9, wherein the second temperature is higher than the first temperature.

14. An apparatus for recording data in a thermosensitive recording medium, comprising:

a writing member for repetitively writing data in the recording medium at a first temperature;

an erasing member for repetitively erasing data written in the recording medium at a second temperature and located upstream of said writing member in an intended direction of transport of said recording medium for a writing operation; and control means for controlling a heating temperature of said erasing member such that said heating temperature is higher than a temperature necessary for data just written in the recording medium to be immediately erased.

15. An apparatus as claimed in claim 14, wherein the second temperature is higher than the first temperature.

* * * * *